US006869272B2

(12) United States Patent
Odachi et al.

(10) Patent No.: US 6,869,272 B2
(45) Date of Patent: Mar. 22, 2005

(54) ELECTRIC COMPRESSOR AND CONTROL METHOD THEREFOR

(75) Inventors: Yasuharu Odachi, Aichi-ken (JP); Kazuya Kimura, Aichi-ken (JP); Shoichi Ieoka, Aichi-ken (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 55 days.

(21) Appl. No.: 10/197,129

(22) Filed: Jul. 17, 2002

(65) Prior Publication Data

US 2003/0017054 A1 Jan. 23, 2003

(30) Foreign Application Priority Data

Jul. 18, 2001 (JP) ..... 2001-218451

(51) Int. Cl.[7] ..... F04B 49/06

(52) U.S. Cl. ..... 417/44.1; 417/44.11; 417/42

(58) Field of Search ..... 417/44.1, 44.11, 417/42, 45; 318/565, 138, 254, 439, 721, 432, 433, 268, 269, 270, 271, 272; 388/909

(56) References Cited

U.S. PATENT DOCUMENTS

| | | | | |
|---|---|---|---|---|
| 4,240,020 A | * | 12/1980 | Okuyama et al. | 318/721 |
| 5,253,481 A | | 10/1993 | Takagi et al. | 62/126 |
| 5,272,429 A | * | 12/1993 | Lipo et al. | 318/808 |
| 5,384,527 A | * | 1/1995 | Rozman et al. | 322/10 |
| 5,518,373 A | | 5/1996 | Takagi et al. | 417/45 |
| 6,037,741 A | * | 3/2000 | Yamada et al. | 318/721 |
| 6,208,109 B1 | * | 3/2001 | Yamai et al. | 318/716 |
| 6,320,349 B1 | * | 11/2001 | Kaneko et al. | 318/798 |
| 6,396,229 B1 | * | 5/2002 | Sakamoto et al. | 318/439 |
| 6,462,491 B1 | * | 10/2002 | Iijima et al. | 318/254 |
| 6,462,492 B1 | * | 10/2002 | Sakamoto et al. | 318/254 |
| 6,501,243 B1 | * | 12/2002 | Kaneko et al. | 318/700 |
| 6,555,988 B2 | * | 4/2003 | Masaki et al. | 318/721 |
| 6,657,413 B2 | * | 12/2003 | Nakatsugawa et al. | 318/700 |
| 2001/0028202 A1 | * | 10/2001 | Chen | 310/189 |

FOREIGN PATENT DOCUMENTS

| | | | |
|---|---|---|---|
| JP | 5-99165 | 4/1993 | F04C/18/02 |
| JP | 6-241183 | 8/1994 | F04C/29/10 |
| JP | 8-219071 | 8/1996 | F04C/29/10 |

OTHER PUBLICATIONS

Takeshita, et al. "Initial Rotor Position Estimation of Sensorless Salient–Pole Brushless DC Motor", T.IEE Japan, vol. 116–D, No. 7, 1996 P. 736–P. 742.

Nishida et al., "Evaluation of Estimation Accuracy in Mechanical Sensor–less Rotor Position Detecting Method of Permanent Magnet Motor using Current Vector Locus", National Convention of Institute of Electrical Engineers Industrial Application, 180, p. 195–p. 198, 1995.

Takeshita, et al. "Black EMF Estimation—Based Sensorless Salient–Pole Brushless DC Motor Drives", T.IEE Japan, vol. 117–D, No. 1, '97 , p. 98–P. 104.

* cited by examiner

*Primary Examiner*—Michael Koczo
*Assistant Examiner*—William H. Rodriguez
(74) *Attorney, Agent, or Firm*—Morgan & Finnegan, LLP

(57) ABSTRACT

When an electric compressor is activated, initial current data is selected by a selector, and a motor is driven with the torque corresponding to the initial current data. When the motor is driven by a ½ turn, the selector selects current difference data. The current difference data corresponds to an instructed speed. After the switch of the selector, the motor is driven to rotate at the instructed speed.

5 Claims, 6 Drawing Sheets

ELECTRIC COMPRESSOR AND CONTROL METHOD THEREFOR

BACKGROUND OF THE INVENTION

1. Field of the Invention

The present invention relates to a method of controlling an electric compressor, and more specifically to a method of controlling a motor provided for an electric compressor.

2. Description of the Related Art

An electric compressor is widely used in various fields, for example, an air-conditioner, a refrigerator, etc.

An electric compressor is provided with a motor, and realizes a cooling capability by compressing a refrigerant using the rotary motion of the motor. The motor is controlled such that, for example, it can be operated at a constant speed, based on difference between a user-specified temperature and the current actual temperature, etc.

The speed of a motor (rotational speed) can be controlled basically by monitoring the position of a rotor using a position sensor such as a Hall device, etc. However, in the electric compressor, it is desired to use a system of controlling the speed of a motor by estimating the position of a rotor based on the electromotive force, current, etc. of the motor (hereinafter referred to as a sensorless system) instead of using such a position sensor. Normally, in the sensorless system, the rotational speed is given as a control instruction value, and the motor is driven such that the actual rotational speed matches the control instruction value.

However, if a compressor is left in unoperational state for a long time, then the refrigerant in gaseous form during the operation of the compressor may be liquefied and left in the compressor. When the compressor is driven in this state, the motor requires large torque. Especially when a predetermined rotational speed is given as a control instruction value in the sensorless system, and the motor is to be driven according to the control instruction value, very large torque is required and the motor is sometimes driven asynchronously. Additionally, this large torque also requires an inverter circuit with large capacity.

The method of solving the above mentioned problems with the electric compressor is described in, for example, Japanese Patent Application Laid-open No. Heisei 6-241183 (U.S. Pat. No. 5,518,373). The electric compressor described in this official gazette discharges a liquid refrigerant by operating the motor in step mode for a predetermined period at the start of driving the motor, and then enters a normal operation mode. However, this method described in the official gazette may take a long time to perform the operation of discharging the liquid refrigerant. Furthermore, although some other methods are introduced in the above mentioned official gazette, there are the problems that the compressor is large, the liquid refrigerant cannot be completely removed, and the compressor itself vibrates, etc.

SUMMARY OF THE INVENTION

The present invention aims at providing a method of controlling an electric compressor such that the motor can be efficiently driven while preventing the motor from getting asynchronous.

The method according to the present invention is to control the electric compressor provided with a motor used to compress a refrigerant, and includes the steps of driving the motor with predetermined torque until a rotor of the motor rotates by a predetermined amount of rotation; and driving the motor at a predetermined speed after the rotor rotates by the predetermined amount of rotation.

When the electric compressor is left in unoperational state for a long time, the refrigerant in gaseous form during the operation of the compressor may be liquefied, and may be left inside the compressor. When the compressor is driven in this state, an enormous load is applied on the motor.

According to the method of the present invention, the motor is driven with a predetermined torque when the electric compressor is activated, and the residual refrigerant is discharged by the operation of the motor. When the motor is driven by the predetermined amount of rotation, it is assumed that the residual refrigerant has been discharged, and the motor is driven at a predetermined speed.

If there is no liquid refrigerant left when the electric compressor is activated, then the load on the motor has to be light. Therefore, if the motor is driven with predetermined torque, it is driven by the predetermined amount of rotation within a short time. Then, the motor may be driven at a predetermined speed within a short time after the electric compressor is activated.

On the other hand, if a liquefied refrigerant is left when the electric compressor is activated, then the load on the motor has to be heavy. Therefore, when the motor is driven with predetermined torque, the motor slowly rotates, but an asynchronous operation is avoided.

In another aspect of the method according to the present invention, an initial position of the rotor of the motor is estimated or detected when the electric compressor is activated. In a further aspect of the method according to the present invention, the motor is driven in a constant torque mode when the electric compressor is activated until the rotor rotates by the predetermined amount of rotation; and an operation mode of the motor is switched from the constant torque mode to a constant speed mode, when the rotor is driven by a predetermined amount of rotation from the initial position in the constant torque mode. In these methods, the similar effect may be obtained by the above mentioned function.

DESCRIPTION OF THE PREFERRED EMBODIMENTS

The embodiments of the present invention are described below by referring to the attached drawings.

Figure 1:
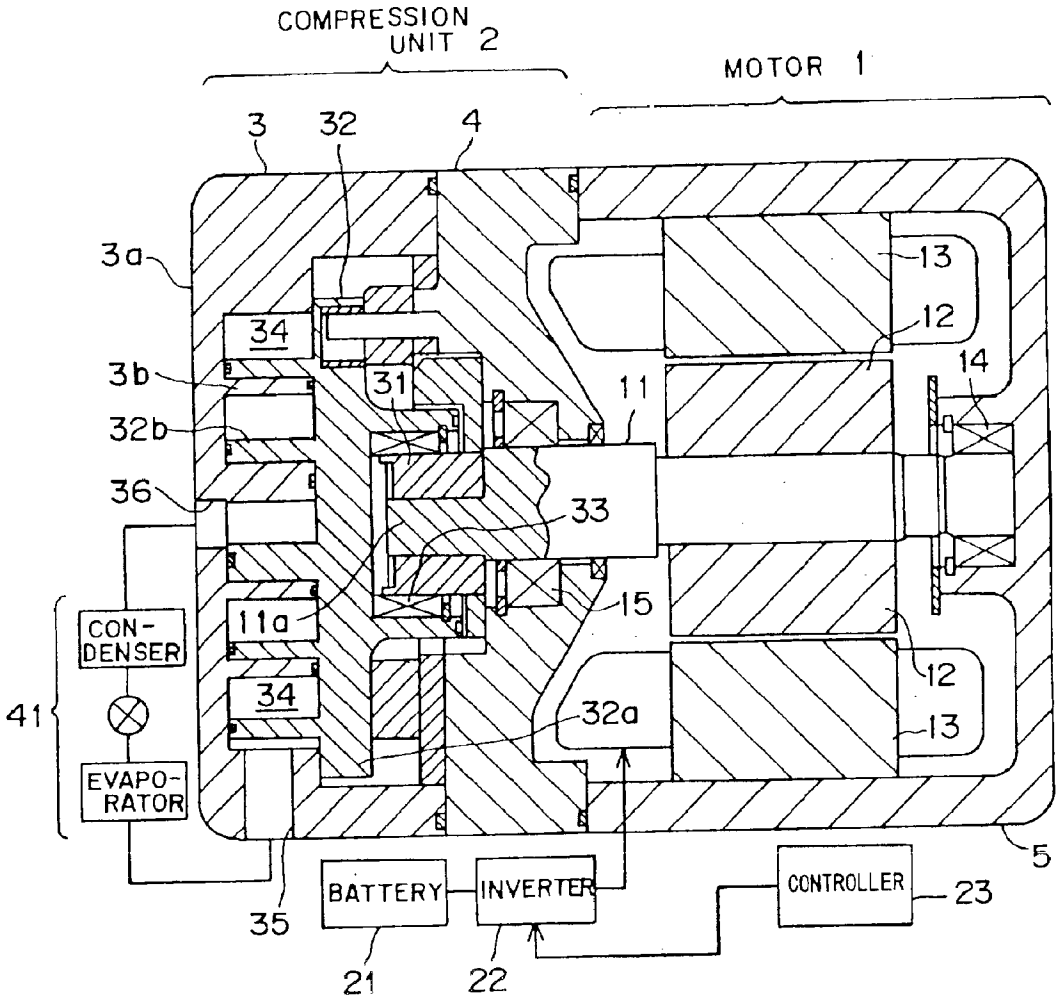
FIG. 1 is a sectional view of the electric compressor according to an embodiment of the present invention.

FIG. 1 is a sectional view of an electrically scroll-type compressor according to an embodiment of the present invention. This electric compressor comprises a motor 1 and a compression unit 2. The housing of the electric compressor comprises a fixed scroll 3, a center housing 4, and a motor housing 5. The fixed scroll 3 includes a fixed end plate 3*a* and a fixed spiral wall 3*b* extended from the fixed end plate 3*a*.

The motor 1 comprises a shaft 11, a rotor 12, a stator 13, etc. The shaft 11 is supported by the center housing 4 and the motor housing 5 with bearings 14 and 15. An eccentric shaft 11*a* is formed at the end of the shaft 11. The rotor 12 is fixed to the shaft 11, and rotates in synchronization with the shaft 11. The stator 13 is provided as encompassing the rotor 12. The stator 13 is provided with a plurality of salient poles, around each of which a coil is wound. The coil wound around each salient pole of the stator 13 is used as a U-phase coil, V-phase coil, and a W-phase coil.

The motor 1 is supplied with power from a battery 21. The DC power output from the battery 21 is converted into an AC by an inverter 22, and supplied to the motor 1. The inverter 22 is controlled by a controller 23.

A bush 31 is attached to the eccentric shaft 11*a*. A movable scroll 32 is supported by the bush 31 with a bearing 33. The movable scroll 32 includes a movable end plate 32*a* and a movable spiral wall 32*b* extended from the movable end plate 32*a* for engagement with the fixed spiral wall 3*b* of the fixed scroll 3. An area sectioned by the fixed end plate 3*a*, the fixed spiral wall 3*b*, the movable end plate 32*a*, and the movable spiral wall 32*b* configures a compression chamber 34. The electric compressor according to this embodiment comprises a plurality of compression chambers 34.

When the motor 1 with the above mentioned configuration is operated and the eccentric shaft 11*a* rotates, the movable scroll 32 orbits. Although not specifically explained, the electric compressor is provided with a structure for preventing the movable scroll 32 from rotating on its axis.

An external refrigerant circuit (refrigeration cycle) 41 is provided with a condenser, an evaporator, etc., performs a condensing process and an evaporating process on a refrigerant gas discharged from the compression unit 2, and circulates the refrigerant gas to the compression unit 2.

A suction port 35, which is used for connecting the evaporator of the external refrigerant circuit 41 to the compression chamber 34 at the outer periphery of the spiral walls 3*b* and 32*b*, is provided for the exterior of the fixed scroll 3. In the central portion of the fixed end plate 3*a*, an discharge port 36, which is used for connecting the compression chamber 34 at the inner periphery of the spiral walls 3*b* and 32*b* to the condenser of the external cooling circuit 41, is provided.

In this electric compressor, when the motor 1 is operated, the shaft 11 rotates, and the movable scroll 32 orbits. When the movable scroll 32 orbits, the volume of the compression chamber 34 decreases as the compression chamber 34 at the outer periphery of the spiral walls 3*b* and 32*b* moving toward inner periphery of the spiral walls 3*b* and 32*b*. As a result, the refrigerant taken into the compression chamber 34 is compressed, and then the compressed refrigerant is discharged to the external refrigerant circuit 41 through the exhaustion port 36.

As described above, this electric compressor is provided with a plurality of compression chambers 34. By driving the motor 1, the above mentioned suction process, compression process, and discharge process are sequentially performed on each compression chamber 34.

When this electric compressor stops its operation, refrigerant gas is normally left in at least one of the plurality of compression chamber 34. The refrigerant gas becomes liquefied if it is left for a long time. That is to say, if the electric compressor is left in unoperational state for a long time, then the liquefied refrigerant is left in the compression chamber 34. Therefore, when the electric compressor is activated, it is necessary first to discharge the liquefied refrigerant.

Figure 2:
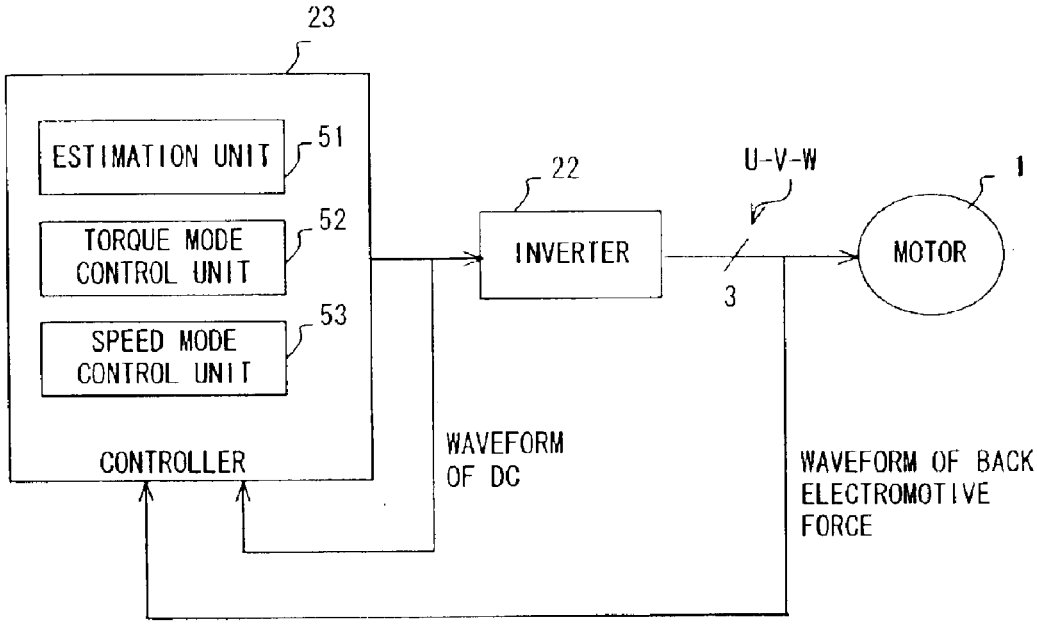
FIG. 2 is a block diagram of the control system for driving a motor provided for an electric compressor.

FIG. 2 is a block diagram of the control system for driving the motor 1 provided for the electric compressor. According to the present embodiment, it is assumed that the motor 1 is controlled by the sensorless method. That is to say, the motor 1 is not provided with a position sensor for directly detecting the position of a rotor (corresponding to the rotor 12 in FIG. 1), and the position of the rotor is estimated based on a current waveform, an back electromotive force waveform, etc.

The controller 23 comprises an estimation unit 51, a torque mode control unit 52, a speed mode control unit 53, etc. The estimation unit 51 estimates the position of the rotor of the motor 1 based on a current waveform, back electromotive force, etc. In this example, the current waveform is detected on the DC side of the inverter 22, and the inverse electromotive force is detected by monitoring the voltage signal generated in the coil (corresponding to the coil of the stator 13 in FIG. 1) of the motor 1.

The torque mode control unit 52 generates a control signal for driving the motor 1 with specified torque, and transmits it to the inverter 22. The torque of the motor 1 is substantially proportional to the current supplied to the motor 1. On the other hand, the speed mode control unit 53 generates a control signal for driving the motor 1 at a specified speed (rotational speed), and transmits it to the inverter 22.

The inverter 22 generates a 3-phase AC according to the control signal generated by the controller 23, and supplies it to the motor 1. Then, the motor 1 is driven by the 3-phase AC provided by the inverter 22.

According to the present embodiment, the motor 1 is controlled by the sensorless method. However, the present invention does not exclude the configuration of controlling the motor 1 using a position sensor such as a Hall device, etc.

Figure 3:
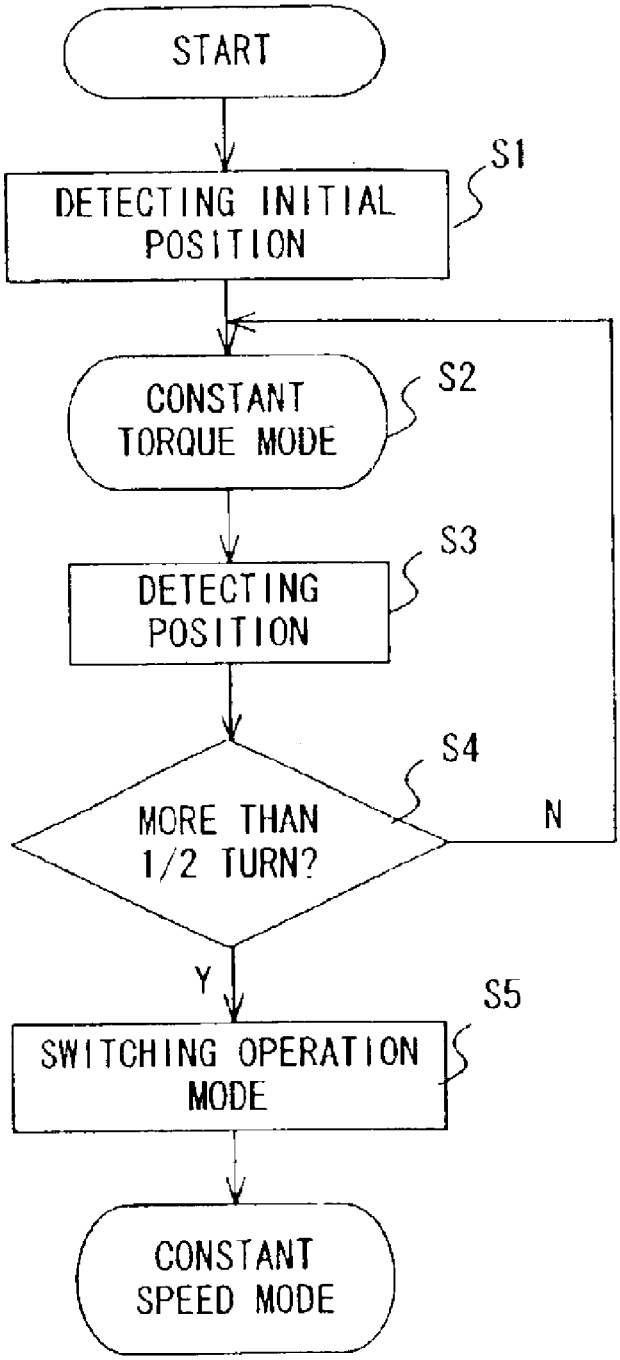
FIG. 3 is a flowchart which shows the operations of a controller.

FIG. 3 is a flowchart of the operation of the controller 23. The process in this flowchart is performed when the electric compressor is activated.

In step S1, the initial position of the rotor of the motor 1 is estimated (or detected). In the sensorless system, the method of estimating the initial position of the rotor can be realized by a well-known technology. In the sensorless system, the method of estimating the initial position of the rotor is described in, for example, the following documents.

(1) Takeshita, Ichikawa, Matsui, Yamada, and Mizutani "Initial Rotor Position Estimation of Sensorless Salient-Pole Brushless DC Motor" in Research Paper of Institute of Electrical Engineers of Japan Vol.116-D, No. 7, 1996.

(2) Nishida and Kondoh "Evaluation of Estimation Precision in PM Motor Position Sensorless Field Magnetic Pole Detecting Method using Current Vector Locus" in National Convention of Institute of Electrical Engineers Industrial Application, 180, 195 (1995–1996)

In step S2, a control signal for driving the motor 1 with predetermined constant torque is generated. The torque of the motor 1 is substantially proportional to the current supplied to the motor 1. Therefore, in step S2, a control signal for supplying predetermined constant current to the motor 1 is generated. A "predetermined constant current" refers to, for example, a maximum rating current of the motor 1.

In step S3, the position of the rotor of the motor 1 is estimated. The method of estimating the position of the rotor of the motor in operation in the sensorless system can be realized by a well-known technology.

In step S4, it is checked whether or not the amount of rotation from the initial position estimated or detected in step S1 to the current position estimated in step S3 exceeds a predetermined amount of rotation. Here, the "predetermined amount of rotation" is, for example, a ½ turn, however, it is not limited to this amount. Then, the motor 1 is driven in the constant torque mode until the amount of rotation from the initial position of the rotor of the motor 1 exceeds ½ turn.

When the motor 1 is driven more than ½ turn, the operation mode of the motor 1 is switched from the constant torque mode to the constant speed mode, thereafter driving the motor 1 in the constant speed mode. The constant speed mode is an operation mode in which the motor 1 is driven at a specified speed (rotational speed).

When the rotor of the motor 1 is not driven to the ½ turn within a predetermined time from the activation of the electric compressor in the process shown in the flowchart, the driving operation of the motor 1 may be stopped.

Thus, in the electric compressor according to the embodiment of the present invention, the motor 1 is driven with predetermined torque when the electric compressor is started. Then, the movable scroll 32 orbits, and the refrigerant left in the compression chamber 34 is discharged to the external refrigerant circuit 41 through the exhaustion port 36.

If no liquid refrigerant is left in the compression chamber 34, then the load for orbiting the movable scroll 32 is to be light. Therefore, if the motor 1 is driven with predetermined torque, the motor 1 can rotate more than ½ turn within a short time. Then, the operation mode of the motor 1 is immediately switched from the constant torque mode to the constant speed mode. That is to say, in this case, the motor 1 is driven in the constant torque mode only for a short time.

On the other hand, if a liquid refrigerant is left in the compression chamber 34, then the load for orbiting the movable scroll 32 is to be heavy. Therefore, if the motor 1 is driven with predetermined torque, the motor 1 rotates slowly. As a result, although it takes a comparatively long time to obtain more than the ½ turn of the motor 1, the occurrence of an asynchronous operation is avoided.

According to the present embodiment, the operation mode of the motor 1 is switched from the constant torque mode to the constant speed mode when the motor 1 is driven more than the ½ turn. However, the present invention is not limited to this value. That is to say, the amount of rotation of the motor 1 for which the switch of the operation mode is specified is to be set to a value at which the liquid refrigerant is discharged from the compression chamber 34 by orbiting the movable scroll 32.

Figure 4:
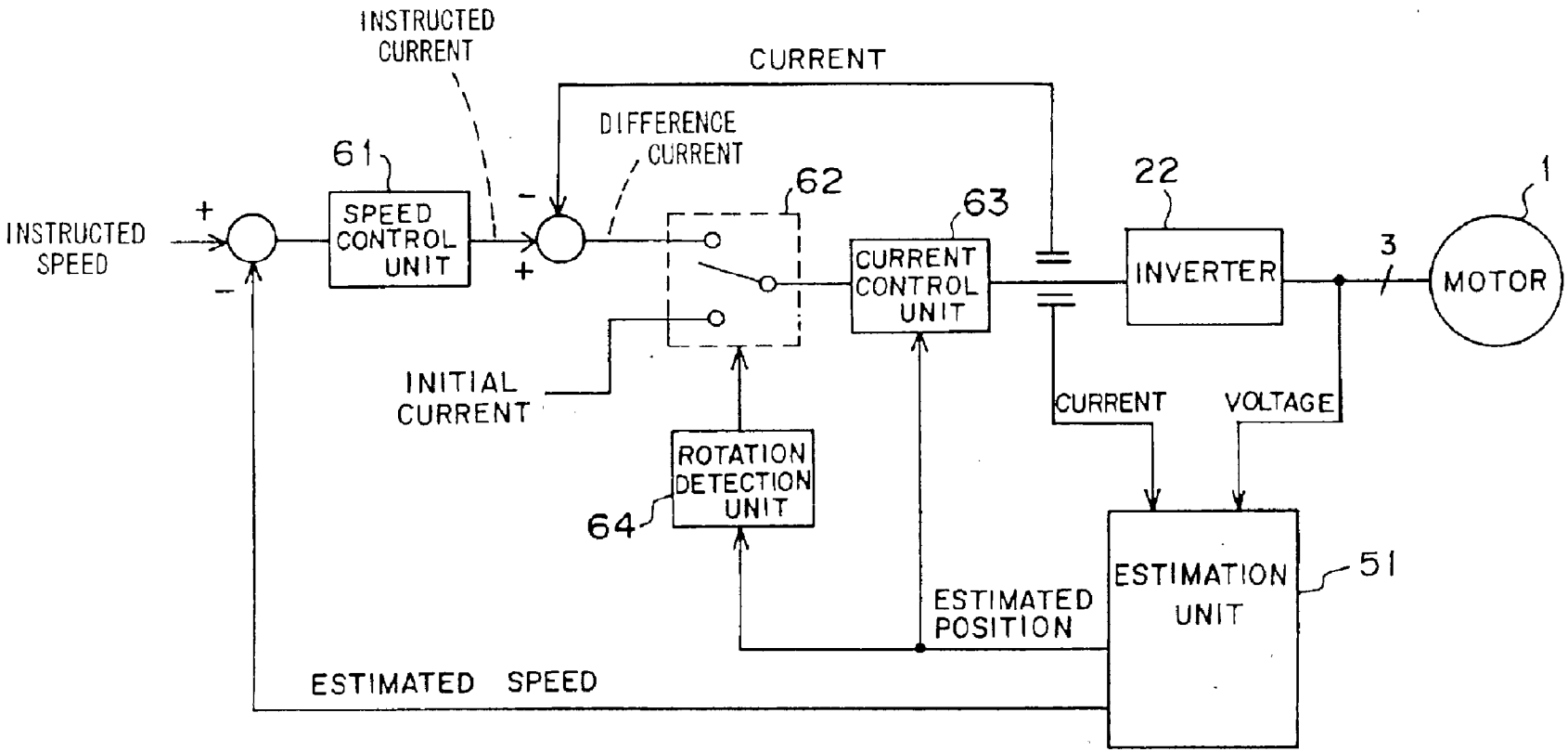
FIG. 4 shows the circuit for driving a motor.

FIG. 4 shows the circuit for driving the motor 1. The circuit corresponds to the controller 23 shown in FIGS. 1 or 2.

A speed control unit 61 is, for example, a PI (proportion/integral) controller, and computes instructed current data from difference between externally provided instructed speed data and the estimated speed data computed by the estimation unit 51. The instructed speed data specifies the rotational speed when the motor 1 is driven in the constant speed mode.

A selector 62 selects one of current difference data and initial current data at an instruction from a rotation detection unit 64. The current difference data refers to difference between the instructed current data computed by the speed control unit 61 and the motor current data obtained by detecting the current supplied to the motor 1 by a current sensor 65. The initial current data refers to the current value corresponding to the maximum rating current or the maximum rating torque of the motor 1.

A current control unit 63 is, for example, a PI controller, and generates a drive signal for driving the inverter 22 using the data selected by the selector 62 and the estimated position computed by the estimation unit 51. Then, the inverter 22 generates a 3-phase AC to be applied to the motor 1 according to the drive signal generated by the current control unit 63.

The estimation unit 51 estimates the position of the rotor of the motor 1 based on the motor-applied voltage and/or motor current. The estimation unit 51 computes the estimated speed of the motor 1 using the estimated position. The estimation unit 51 performs the estimating process at predetermined time intervals. The position of the rotor of the motor 1 can be estimated by the well-known technology.

When the electric compressor is activated, the rotation detection unit 64 issues an instruction to select initial current data to the selector 62. It also estimates the position of the rotor of the motor 1, and stores the estimated value as initial position data. Then, the rotation detection unit 64 computes the amount of rotation from the initial position of the motor 1 each time the estimated position data is output from the estimation unit 51. When the rotation detection unit 64 detects that the motor 1 has been driven more than a predetermined amount, it issues an instruction to select current difference data to the selector 62.

The operation of this control is described below. That is, when the electric compressor is activated, the selector 62 selects the initial current data. Therefore, the motor 1 is driven with the torque corresponding to the initial current data. When the motor 1 is driven by a predetermined amount of rotation (for example, ½ turn), the selector 62 selects current difference data. Therefore, the motor 1 is driven to rotate at a speed corresponding to the command speed data. That is to say, the operation mode of the motor 1 is switched from the constant torque mode to the constant speed mode.

In the above mentioned embodiment, the scroll-type electric compressor is described. However, the present invention is not limited to this application, but can be applied to, for example, an electric swash plate type compressor.

Figure 5:
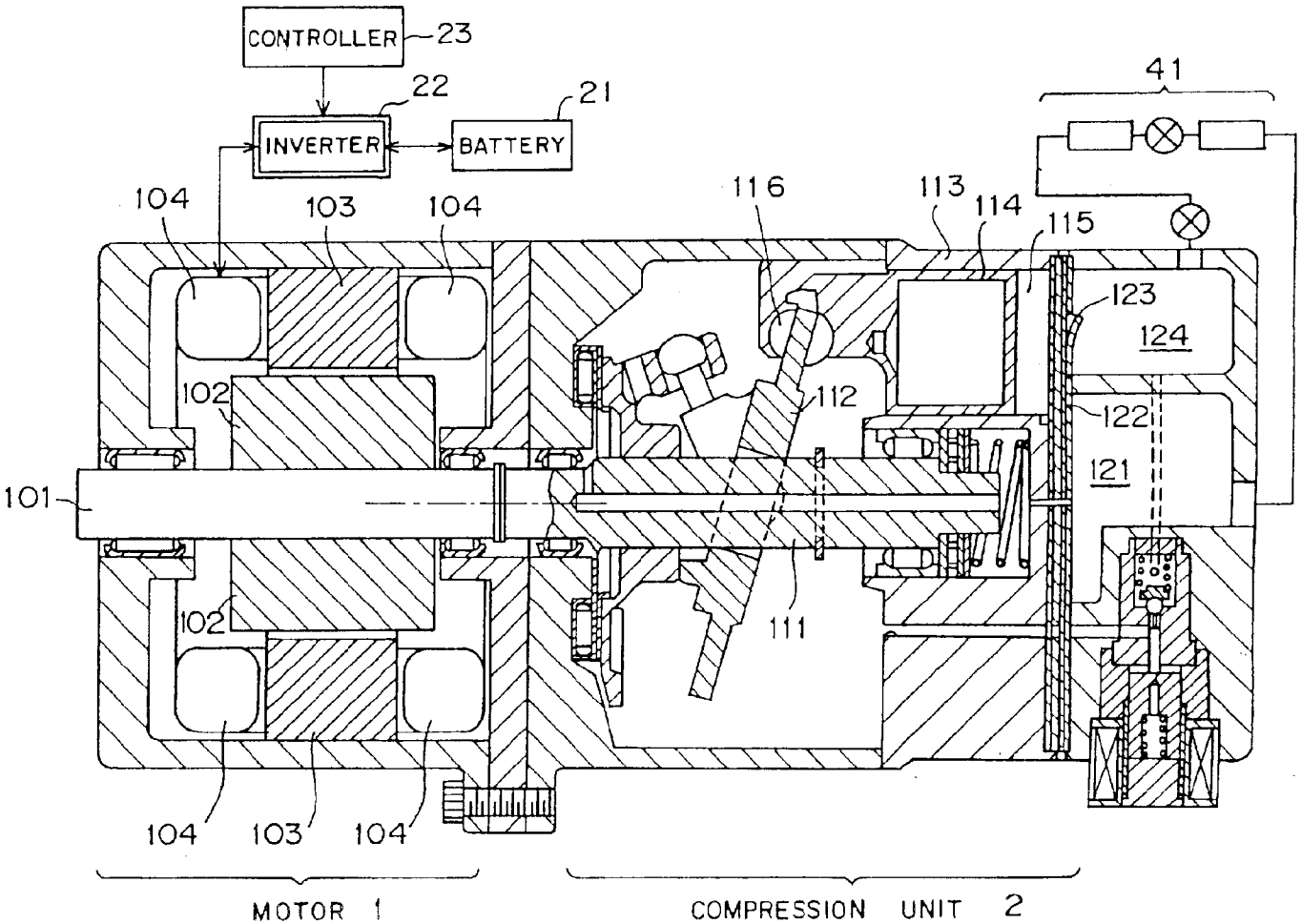
FIG. 5 is a sectional view of the electric compressor according to the second embodiment of the present invention.

FIG. 5 is a sectional view of an electric swash plate type compressor according to the second embodiment of the present invention. This electric compressor also comprises the motor 1 and the compression unit 2.

The motor 1 comprises a rotational shaft 101, a magnet 102, a stator core 103, a coil 104, etc. The magnet 102 is a rotor fixed to the rotational shaft 101, and rotates in synchronization with the rotational shaft 101. The stator core 103 is provided as surrounding the magnet 102. A plurality of (for example, nine) stator cores 103 are provided here. Furthermore, the coil 104 (for example, a U-phase coil, a V-phase coil, and a W-phase-coil) is wound around each stator core 103.

The compression unit 2 comprises a rotational shaft 111, a swash plate 112, a cylinder bore 113, a piston 114, etc. The rotational shaft 111 is linked to the rotational shaft 101 of the motor 1, and rotates in synchronization with the rotational shaft 101 when the motor 1 is driven. The swash plate 112 is supported to rotate in synchronization with the rotation of the rotational shaft 111. The plurality of cylinder bores 113 are formed to surround the rotational shaft 111. In FIG. 5, only one cylinder bore is shown. The piston 114 is linked to the swash plate 112 through a shoe 116, and is accommodated in the cylinder bore 113 such that the rotation motion of the swash plate 112 causes a reciprocating linear motion of the piston 114.

In this electric compressor, when the motor 1 is driven, the rotational shaft 111 rotates in synchronization with the motor 1. The rotary motion of the rotational shaft 111 is converted into the reciprocating linear motion of the piston 114 by the swash plate 112 and the shoe 116. At this time, the volume of a compression chamber 115 in the cylinder bore 113 is changed depending on the position of the piston 114. That is to say, the volume of the compression chamber 115 is the maximum when the piston 114 is positioned at the bottom dead point, and the minimum when it is positioned at the top dead point.

A refrigerant gas is fed from the external refrigerant circuit 41 to a suction chamber 121. When the piston 114 starts moving from the top dead point to the bottom dead point, the refrigerant gas is drawn from the suction chamber 121 to the compression chamber 115 through a suction valve 122. When the piston 114 moves from the bottom dead point to the top dead point, the refrigerant gas drawn to the compression chamber 115 is compressed. When the pressure in the compression chamber 115 rises up to a predetermined value, the compressed refrigerant gas is discharged to a discharge chamber 124 through a discharge valve 123. The refrigerant gas discharged to the discharge chamber 124 is circulated to the suction chamber 121 through the external refrigerant circuit (refrigeration cycle) 41.

When the operation of the electric compressor is stopped, the refrigerant gas may be left in the compression chamber 115 depending on the situation. Therefore, when the electric compressor is activated, it is necessary to discharge the liquid refrigerant left in the compression chamber 115 as in the case of the scroll-type compressor shown in FIG. 1.

Figure 6A:
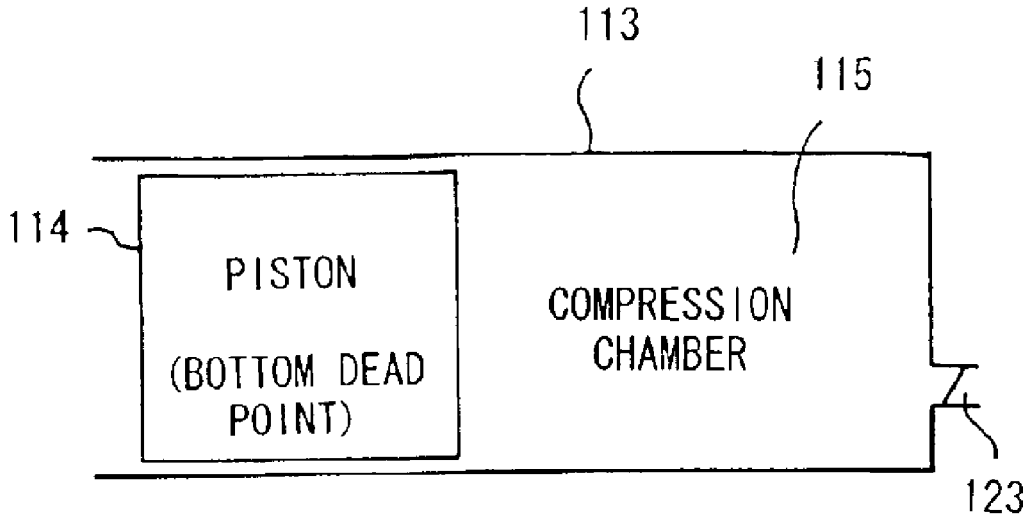
FIGS. 6A and 6B show the relationship between the position of a piston and the discharge of a refrigerant.
Figure 6B:
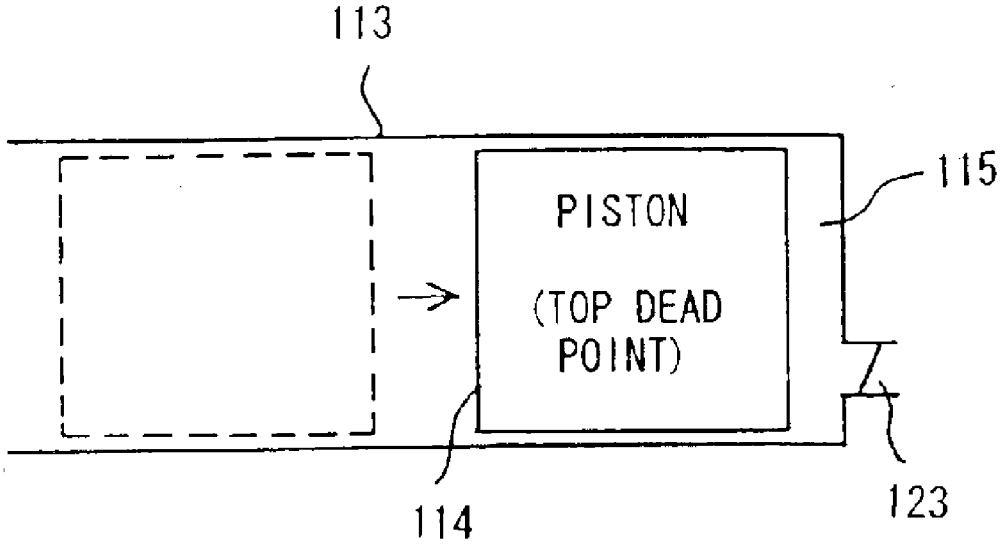

FIGS. 6A and 6B show the relationship between the position of a piston and the discharge of the refrigerant. As shown in FIG. 6A, if the piston 114 is at the bottom dead point when the electric compressor is activated, then the refrigerant left in the compression chamber 115 may be discharged by moving the piston 114 to the top dead point as shown in FIG. 6B. Assuming that the piston 114 makes one reciprocating motion when the motor 1 makes one rotation, the motor 1 is to be driven a ½ turn to move the piston 114 from the position shown in FIG. 6A to the position shown in FIG. 6B. That is to say, in this case, if the motor 1 is driven only ½ turn, then the refrigerant is discharged from the compression chamber 115. On the other hand, if the piston 114 is in the top dead point when the electric compressor is activated, then there is no refrigerant left in the compression chamber 115. Therefore, considering these conditions taken into account, the refrigerant is basically to be discharged from the compression chamber 115 regardless of the position of the piston 114 of the electric compressor if the motor 1 is driven ½ turn.

However, to discharge the refrigerant left in the compression chamber 115 completely, the motor 1 may be driven in a constant torque mode until the piston 114 makes one reciprocating motion.

In the embodiment above, the motor 1 is driven in the constant torque mode when the electric compressor is activated. However, the present invention is not limited to this application. That is, the motor 1 may be driven with the torque set as a control parameter when the electric compressor is activated, and it is not necessary to drive the motor 1 with constant torque.

Additionally, in the embodiment above, the motor 1 is driven in a constant speed mode after a liquid refrigerant is discharged. However, the present invention is not limited to this application. That is, the motor 1 may be driven with the speed set as a control parameter, and it is not necessary to drive the motor 1 at a constant speed.

Furthermore, in the embodiment above, the initial position of the rotor of the motor 1 is estimated according to the well-known technology. However, the present invention is not limited to this feature. That is, a current of a predetermined pattern is applied to the U-phase, V-phase, and W-phase of the motor 1, and the rotor may be controlled to forcibly match the position corresponding to the pattern. For this method, the Applicant of the present invention filed for a patent application (Patent Application JP-2001-174499).

Additionally, the above mentioned embodiment is based on the sensorless system, but the present invention is not limited to it. That is to say, the present invention can be applied to the control system for directly detecting the position of the rotor of the motor 1 using the Hall device, etc.

According to the present invention, a motor does not become asynchronous when a liquid refrigerant left when the electric compressor is activated is discharged. Within a minimal time, the motor can enter a normal operation mode.

What is claimed is:

1. A method for controlling an electric compressor having a motor for use in compressing a refrigerant, comprising:

driving the motor with predetermined torque until a rotor of the motor rotates by a predetermined amount of rotation; and driving the motor at a predetermined speed after the rotor rotates by the predetermined amount of rotation.

2. The method according to claim 1 further comprising:

estimating or detecting an initial position of a rotor of the motor when the electric compressor is activated.

3. The method according to claim 1 further comprising:

driving the motor in a constant torque mode when the electric compressor is activated until the rotor rotates by the predetermined amount of rotation; and switching an operation mode of the motor from the constant torque mode to a constant speed mode, when the rotor is driven by a predetermined amount of rotation from the initial position in the constant torque mode.

4. An electric compressor having a motor for use in compressing a refrigerant, comprising:

a controller including an estimation unit estimating or detecting an initial position of a rotor of the motor when the electric compressor is activated;

a torque mode control unit driving the motor with predetermined torque; and a speed mode control unit driving the motor at a predetermined speed after the rotor is driven by a predetermined amount of rotation from the initial position with the instruction of the torque mode control unit.

5. The electric compressor according to claim 4, further comprising:

a current detecting unit detecting a current flowing through the motor, wherein said motor is driven based on a current detected by said current detection unit.

* * * * *